United States Patent [19]

Duplessy et al.

[11] Patent Number: 4,611,419

[45] Date of Patent: Sep. 16, 1986

[54] TROUSER PRESS

[76] Inventors: Patrice Duplessy, 18, rue du Prieurie, Ecully; Hervé Duplessy, Le Val Saint Germain, St. Cheron, both of France

[21] Appl. No.: 707,875

[22] Filed: Mar. 4, 1985

[30] Foreign Application Priority Data

Mar. 6, 1984 [FR] France ..... 84 03783
Nov. 20, 1984 [FR] France ..... 84 17832

[51] Int. Cl.[4] ..... D06F 72/29
[52] U.S. Cl. ..... 38/21; 38/72
[58] Field of Search ..... 38/21, 22, 17, 71, 72; 223/73; 219/243, 345; 100/93 P

[56] References Cited

U.S. PATENT DOCUMENTS

| | | | |
|---|---|---|---|
| 1,183,772 | 5/1916 | Rosenbloom | 223/73 |
| 1,420,822 | 6/1922 | Dewey et al. | 38/71 |
| 1,821,597 | 9/1931 | Wanden et al. | 38/71 |
| 1,950,498 | 3/1934 | Lehnen et al. | 38/71 |
| 2,047,837 | 7/1936 | Schmieglitz | 38/71 |
| 2,805,010 | 9/1957 | Brookhart | 223/73 X |
| 3,425,141 | 2/1969 | Fuhring et al. | 38/21 |
| 3,484,028 | 12/1969 | McMillan | 223/73 |
| 3,514,021 | 5/1970 | DeDube | 38/71 |

FOREIGN PATENT DOCUMENTS

| | | | |
|---|---|---|---|
| 2144983 | 3/1973 | Fed. Rep. of Germany | 38/71 |
| 537242 | 5/1922 | France . | |
| 2402027 | 4/1979 | France | 38/21 |
| 376249 | 5/1964 | Switzerland | 223/73 |

*Primary Examiner*—Werner H. Schroeder
*Assistant Examiner*—Andrew M. Falik
*Attorney, Agent, or Firm*—Karl F. Ross; Herbert Dubno

[57] ABSTRACT

A trouser press has a pair of similar elongated boards each having a pair of generally parallel, vertical, and longitudinal edges and upper and lower transverse edges bridging same and a heating plate similar to and between the boards and having respective such longitudinal and transverse edges. The plate and normally the boards also are formed at the respective upper edges with cutouts so that a pair of trousers can be positioned with one trouser leg on one side of the plate, one trouser leg on the other, the trouser waistband generally at the upper edges, and the trouser crotch at the cutout. Hinges attach the boards and plate together in registration with the heating plate sandwiched between the boards for pivoting of each of the boards relative to the plate. Grippers are provided at the upper edges for securing the trouser waistband in the press and clips are provided generally at the lower edges for securing the trouser legs in the press.

11 Claims, 10 Drawing Figures

TROUSER PRESS

FIELD OF THE INVENTION

The present invention relates to a trouser press. More particularly this invention concerns a consumer-type apparatus that automatically presses trousers and that can even be portable.

BACKGROUND OF THE INVENTION

French Pat. No. 537,242 describes a trouser press which encloses the garment to be pressed along its entire length and neatly restores the crease and eliminates wrinkles. This arrangement has a pair of identical boards and a heating plate of the same shape. The one board is laid on a horizontal surface and the trousers are arranged with one leg lying flat on this board. Then the heating plate, which is formed at one end with a cutout, is laid atop this one flat leg with the trousers crotch passing through the heating-plate cutout. The other leg is flattened out atop this heating plate, and the other board is put on top of this leg. The boards are then fastened together by some sort of catches and the heating plate is energized for a while so the combined effect of heat and pressure presses the garment.

Obviously the use of such a device is relatively onerous, and some judge it harder than pressing the trousers with a standard iron and ironing board. The device is cumbersome to use and takes up a fair amount of space when being loaded or used.

In addition such an arrangement is wholly for at-home use. It is far too bulky to travel with or pack in luggage.

OBJECTS OF THE INVENTION

It is therefore an object of the present invention to provide an improved trousers press.

Another object is the provision of such a trousers press which overcomes the above-given disadvantages, that is which is easy to use, and which can be made compact enough for convenient travel use.

A further object is the provision of such a press which, even when in use, need not take up a large area.

SUMMARY OF THE INVENTION

A trouser press according to the invention has a pair of similar elongated boards each having a pair of generally parallel, vertical, and longitudinal edges and upper and lower transverse edges bridging same and a heating plate similar to and between the boards and having respective such longitudinal and transverse edges. The plate and normally the boards also are formed at the respective upper edges with cutouts so that a pair of trousers can be positioned with one trouser leg on one side of the plate, one trouser leg on the other, the trouser waistband generally at the upper edges, and the trouser crotch at the cutout. Hinges attach the boards and plate together in registration with the heating plate sandwiched between the boards for pivoting of each of the boards relative to the plate along one of the plate edges and the corresponding board edge, normally one longitudinal edge although hinging at the end is possible. Grippers are provided at the the upper edges for securing the trouser waistband of the trouser in the press and clips are provided generally at the lower edges for securing the legs in the press.

This device can be used upright, since when the outer boards are pivoted apart they form a stable base that can be stood on the lower transverse ends, and the heating plate can then swing relatively easily between them. The trousers are secured at their waistband to the grippers so that the seat part of the trousers is in the right flat position for pressing. Then one cuff is secured in place by the respective clip, the heating board is swung into place atop the thus flattened trouser leg, and the other leg is clipped in place, with the trousers perfectly flat. The device can be clipped shut and used in a vertical position. Obviously this is a relatively simple arrangement that is easy to use.

According to another feature of this invention a pair of guides extending along one of the upper transverse edges slidably carry at least three such grippers with at least one of the grippers offset transversely from another of the grippers. Thus at least both of the front creases can be held by respective grippers and the rear of the trousers by another gripper. Each of the grippers is spring-loaded into a closed position, or can operate toggle-fashion to be held in open and closed positions.

The clips according to this invention each include a flexible leaf spring extending along the lower transverse edges and each concave toward one of the boards. Each of the leaf springs has one end pivoted at the respective one edge which is one of the longitudinal edges and an opposite end. A latch is provided on the other board releasably engageable with the opposite ends of the leaf springs. This latch is spring loaded into a position retaining the leaf springs against the other board. The one ends of the leaf springs are pivoted at the one longitudinal edge of the one board. In addition the leaf-spring clips are slidably carried on at least one longitudinally extending pivot so that the longitudinal positions of the leaf springs can be adjusted for trousers of different lengths.

In accordance with another feature of this invention each of the boards is formed of at least two parts and transversely extending hinges connect each of the parts of each of the boards to another part of the respective board. Similarly, the heating plate is formed of at least two parts and transversely extending hinges connect each of the parts of the plate to another part of the plate. One of the parts of each board is hinged to the corresponding part of the plate and of the other board so the entire device can be folded up into a relatively small size for transport and away-from-home use. The boards and plate are covered with fabric that continues between the parts and forms the hinges.

DESCRIPTION OF THE DRAWING

The above and other features and advantages will become more readily apparent from the following, it being understood that any feature described with reference to one embodiment of the invention can be used where possible with any other embodiment. In the accompanying drawing.

SPECIFIC DESCRIPTION

Figure 1:
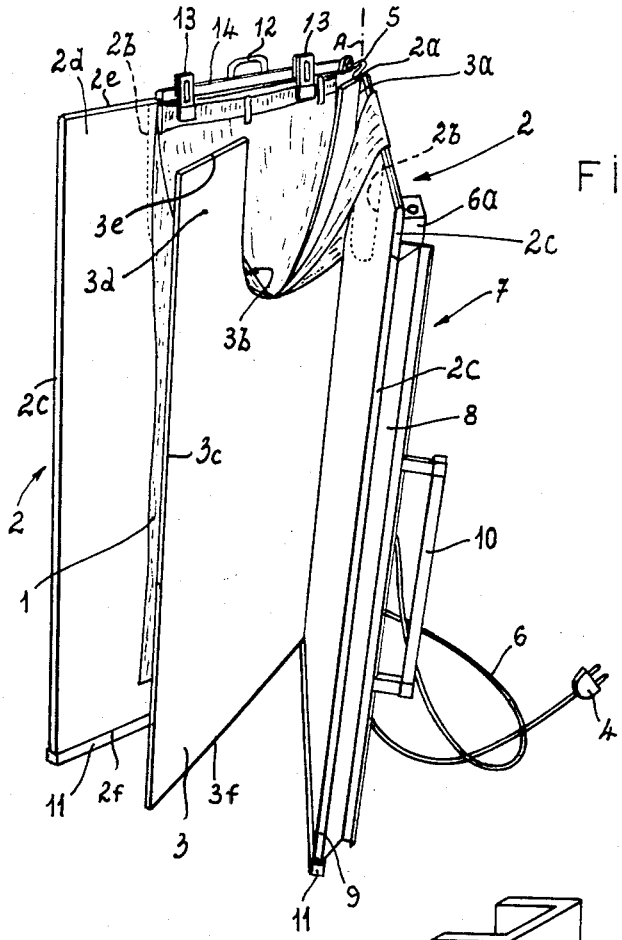
FIG. 1 is a perspective view of the trousers press according to this invention.

As seen in FIGS. 1 through 4, the apparatus according to this invention basically comprises two generally identical boards 2 made of a rigid material such as plywood covered with cloth, and a center heating plate 3 of similar shape. The two boards 2 each have two parallel longitudinal edges 2*a* and 2*c* bridged at the ends by two parallel transverse edges 2*e* and 2*f*, an inner face 2*d* directed toward the inner face 2*d* of the other board 2, and upper and lower transverse edges 2*e* and 2*f*. Similarly the plate 3 has a pair of longitudinal edges 3*a* and 2*c*, outer faces 3*d* confronting the faces 2*d*, and transverse edges 3*e* and 3*f*.

The longitudinal edges 2*a* and 3*a* are connected together by a hinge 5 for pivoting about an axis A parallel to the edges 2*a* and 3*a*. In addition boards 2 and the plate 3 are formed with identical part-circular cutouts 2*b* and 3*b* at the corner of their upper edges 2*e* and 3*e* and their longitudinal edges 2*a* and 3*a*, with a radius of curvature of about 12.5 cm. The cutouts or notches 2*b* are covered up by the cloth covering the boards 2, but the cutout 2*b* is not covered. Thus a pair of trousers 1 can be straddled across the plate 3 at its cutout 3*b* with the crotch of the trousers passing through the cutout 3*b* and one leg lying between the one face 3*d* and the confronting face 2*d* and the other leg between the other face 3*d* and the confronting face 2*d*. The extra layers of fabric in the seat part of the trousers 1 can be accommodated by the cutouts 3*b*.

The plate 3 is of the electric type with internal resistance-type heating elements such as described in U.S. Pat. No. 3,775,588 to Niehenke or of the "Terphane" type having ribbon or wire heating elements imbedded in plastic. It is supplied electric power via a wire 6 and plug 4, and one of the plates 2 carries a timer 6*a* that shuts off the current at a settable time after it is turned on to prevent overheating the garment 1 being pressed, normally limiting the maximum temperature to 60° C. to 90° C.

The lower edges 2*f* of the plates 2 are provided with a reinforcement bar or foot 11 that projects downward below the edge 3*f* and that allows the press to be stood up as shown in FIG. 1. In addition the free edge 2*c* of one of the boards 2 is provided with a closure or latch 7 that is formed by a U-section bar 8 mounted on a pivot rail 9 extending longitudinally along the edge 2*c* and provided with a handle 10. This closure 7 can be pivoted around the other edge 2*c* to lock the two boards 2 together on the legs of the trousers 1 in the position shown in FIG. 3, compressing the legs of the trousers 1 between the boards 2 and the heating plate 3.

A support bar 14 with a handle 12 is provided at the upper end of the plate 3 and has two transversely spaced grippers 13 of the type that is spring-loaded into the closed position. Thus the waistband of the trousers 1 can be secured in these grippers 13 to properly position the garment 1 in the press.

In addition the lower end of the press is provided with two similar leaf-spring clips 22 and 23 each having a free outer end 24 that is bent down and out at 25 and an inner end that is formed as an eye riding on a respective pivot pin 20 extending longitudinally in a respective longitudinal groove or recess 18 or 19 along the inner face 2*d* adjacent the lower edge 2*f* and parallel to the hinged edge 2*a* of one of the plates 2. Thus these clips 22 and 23 can be slid longitudinally along the lower portion of the apparatus so as to be aligned with the cuff of the trousers 1 being pressed.

Figure 3:
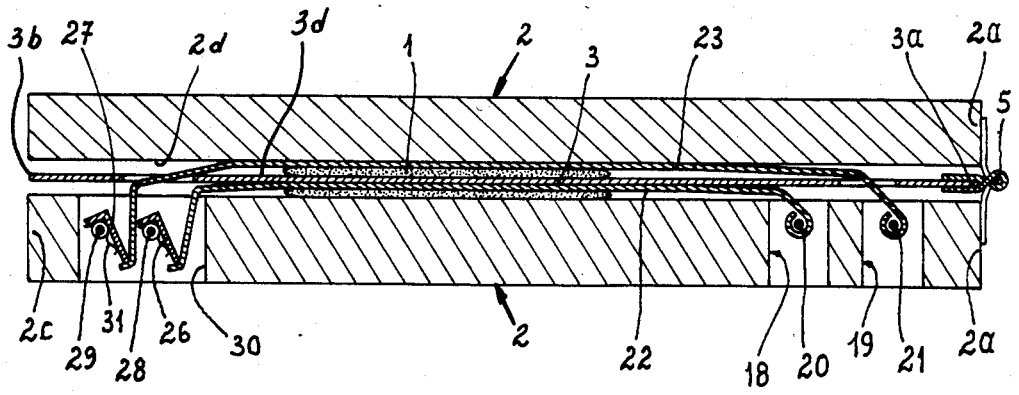
FIG. 3 is a cross section through the closed apparatus according to FIG. 1.
Figure 5:
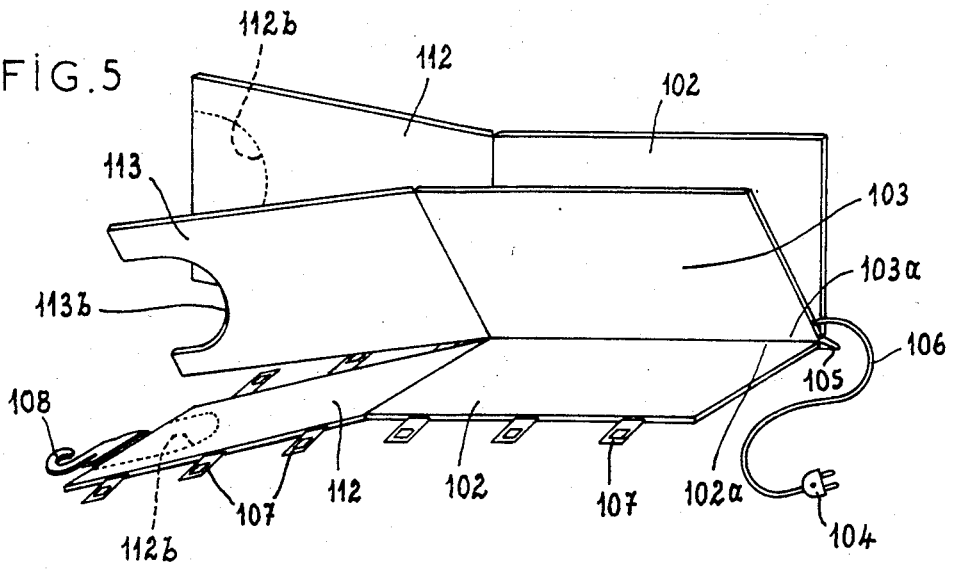
FIGS. 5, 6, 7, 8, and 9 are perspective views of a second pressing device according to the invention in different positions.

The opposite edge 2*c* of the plate 2 formed with the grooves 18 and 19 is formed with a larger recess 30 carrying two latches 26 and 27 on respective pivot pins 18 and 19 and engageable with the bent-out ends 25 of the respective latch springs 22 and 23. The latches 26 and 27 are constituted as L-section 5 mm × 12 mm bars provided with springs 31 that urge them counterclockwise as seen in FIG. 3 so that they can catch behind the ends 25 and lock the springs 22 and 23 against the plate 2. In addition these latch bars 26 and 27 are provided with respective tabs 32 that can be depressed to pivot them clockwise to release the ends 25 and thereby allow the clips 22 and 23 to pivot up. The clips 22 and 23 are concave toward the one board 2 with the clip 22 being between the plate 3 and the one board 2 and the other clip 23 projecting through one window 34 in the plate 3 to lie between the other board 2 and the plate 3. The outer edge 3*c* of the plate 2 is formed with another such window 34 to allow the outer end 24 of this clip 23 to pass through and work with the latch 27.

Thus a pair of trousers 1 is pressed by first opening up the device and standing it on the ground as shown in FIG. 1 and positioning the trousers 1 between the plate 3 and the one plate 2 formed with the recesses 18, 19, and 30. Then the waistband is neatly engaged in the grippers 13 so that the upper creases of the trousers 1 are aligned with each other. One leg is pulled through the cutout 3*b* and the cuff of the other leg is flattened out, with the creases straight, and is held in place by the one clip 22 against the one board 2. Then the plate 3 is closed on the one leg and the other cuff is pressed to the plate 3 by the clip 23. The other plate 2 is then closed and secured shut with the latch 7. The user then sets the timer and in a short time the combination of heat and pressure will automatically and perfectly press the trousers 1.

Figure 4:
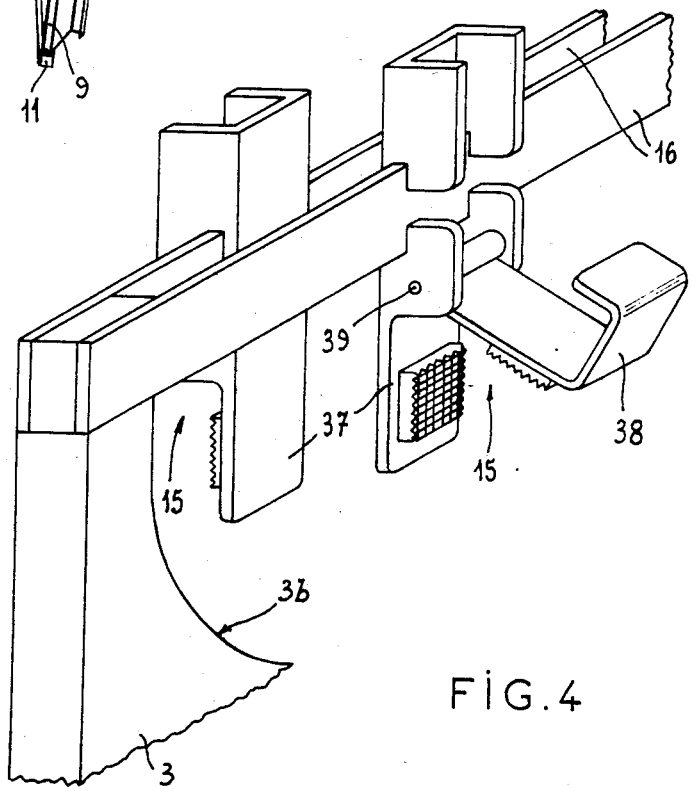
FIG. 4 is a large-scale and partly broken-away view of a detail of a variation on the apparatus of FIG. 1.
Figure 2:
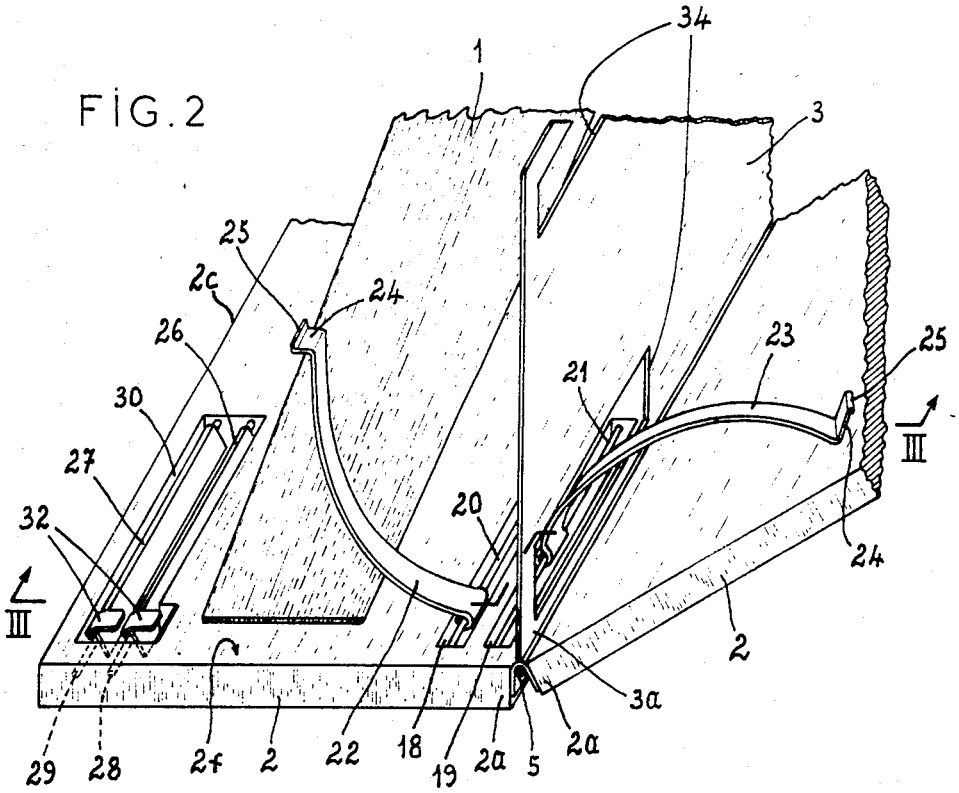
FIG. 2 is a large-scale view of a detail of the apparatus of FIG. 1.

It is also possible as seen in FIG. 4 to provide the upper edge 3*e* of the plate 3 with two guide rails 17 on which four slidable grippers 15 are mounted, two on each. These grippers 15 each have a fixed jaw 37 and a movable jaw 38 secured thereto at a pivot 39. The jaws 38 are operated with a spring toggle-fashion, so that when pulled all the way open they stay open, but when moved past a midway metastable point they snap closed. Thus the trousers 1 are gripped at the front creases and then at the rear or at each rear crease and the grippers 15 are moved transversely apart to flatten out the seat part of the trousers 1. Then the cuffs are secured and the device is closed as described above.

The arrangement of FIGS. 5 through 9 is illustrated in simplified form, but operates in the same manner as the arrangements of FIGS. 1 through 4. The main difference is that this trousers press is intended for use as a portable item that can be folded up and put in a suitcase or easily transported.

To this end a pair of lower board parts 102 are hinged to upper board parts 112 by the cloth surrounding them which forms a transversely extending hinge and similarly they sandwich lower and upper heating-board parts 103 and 113. The cloth which surrounds said upper and lower heating board parts also forms a transversely extending hinge therebetween. The upper parts 112 and 113 are formed with upwardly U-shaped cutouts 112*b* and 113*b* and one of the parts 112 is provided with a hinged handle hook 108 at the fabric covering the respective cutout 113*b*. The lower parts 102 and 103 alone are connected together by a hinge 105 at their edges 102*a* and 103*a* and the heated plate 103, 113 is provided with a cord 106 and plug 104.

Figure 6:
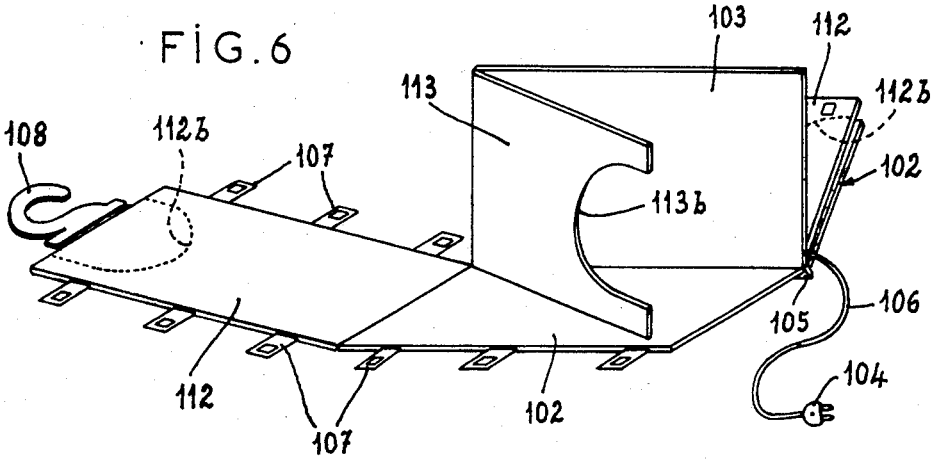
Figure 7:
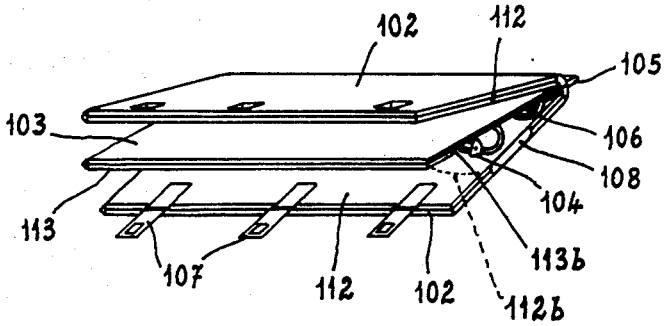
Figure 8:
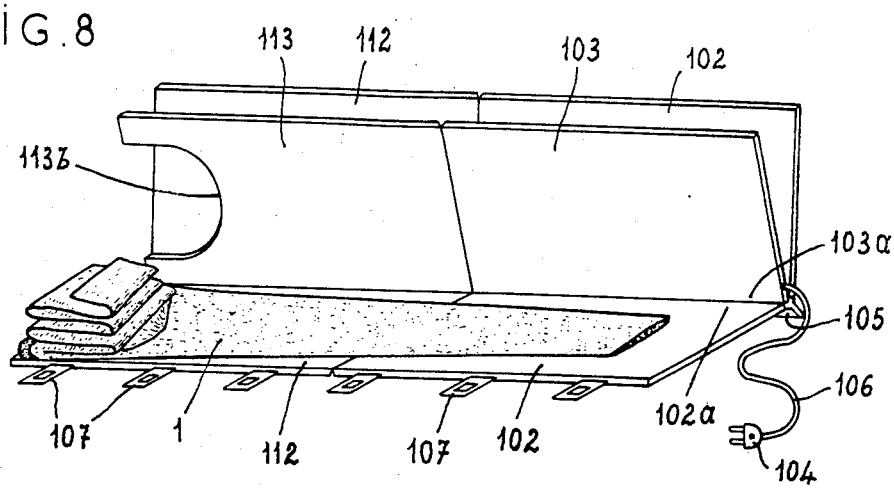
Figure 9:
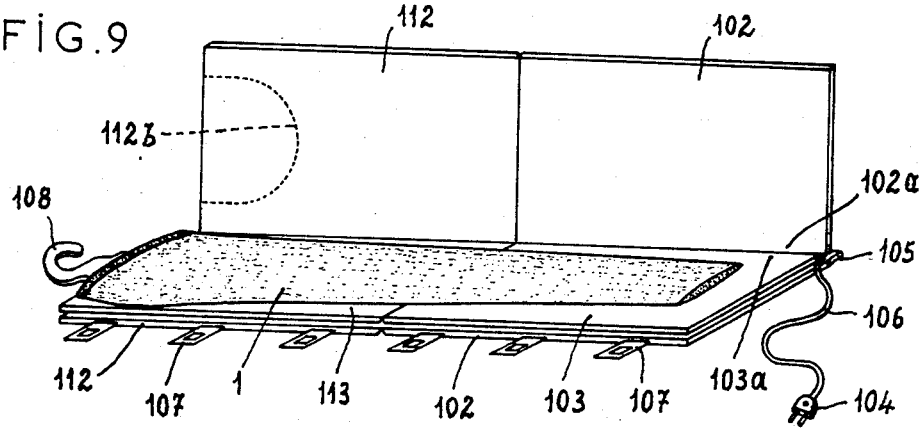

In this system the entire device can be folded up by folding in the hook 108 and then folding the upper parts 112 and 113 as illustrated in FIGS. 6 and 7 to form a neat small unit that is then one half the size of one of the boards 102, 112 or plate 103, 113. It is secured together by simple but efficient hook-and-barb device, that is velcro, fastener straps 107.

Figure 10:
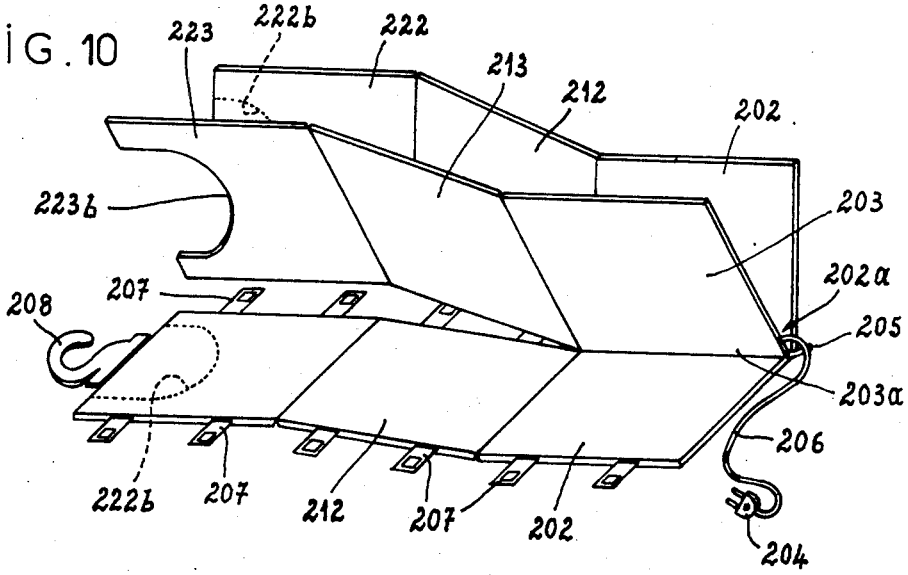
FIG. 10 is a perspective view like FIG. 8 but of a third such apparatus according to this invention.

The arrangement of FIG. 10 is similar, but folds up into thirds. Here a pair of lower board parts 202 are hinged to middle and upper board parts 212 and 222 by the cloth surrounding them and similarly they sandwich lower, middle, and upper heating-board parts 203, 212, and 213. The upper parts 222 and 223 are formed with upwardly U-shaped cutouts 222*b* and 223*b* and one of the parts 222 is provided with a hinged handle hook 208 at the fabric covering the respective cutout 213*b*. The lower parts 202 and 203 alone are connected together by a hinge 205 at their edges 202*a* and 203*a* and the heated plate 203, 212, 213 is provided with a cord 206 and plug 204.

In this system the entire device can be folded up by folding in the hook 208 and then folding over the upper parts 222 and 223 and then the intermediate parts 212 and 222 to form a neat small unit that is one third the size of one of the boards 202, 212, 222 or plate 203, 213, 223 secured together by fastener straps 207.

The system of this invention can press trousers automatically and with ease. The user need merely position them properly in the device and close it. The pressing is automatic so that after a brief time the trousers are neatly pressed and wearable again.

We claim:

1. A trouser press comprising:

a pair of similar elongated boards each having a pair of generally parallel, vertical, and longitudinal edges and upper and lower transverse edges bridging same;

a heating plate similar to and between the boards and having respective such longitudinal and transverse edges, the plate being formed at the respective upper edge with a cutout, whereby a pair of trousers can be positioned with one trouser leg on one side of the plate, one trouser leg on the other, the trouser waistband generally at the upper edges, and the trouser crotch at the cutout;

means for heating the plate;

hinge means attaching the boards and plate together in registration with the heating plate sandwiched between the boards for pivoting of each of the boards relative to the plate along one of the plate edges and the corresponding board edge;

means including grippers at the upper edges for securing the trouser waistband of the trouser in the press; and further means including clips generally at the lower edges for securing the legs in the press, said further means including a pair of guides extending along one of the upper transverse edges and at least three such grippers slidable transversely therealong with at least one of the grippers offset transversely from another of the grippers, whereby at least both of the front creases can be held by respective grippers and the rear of the trousers by another gripper.

2. The trouser press defined in claim 1 wherein each of the grippers is spring-loaded into a closed position.

3. The trouser press defined in claim 1 wherein the clips each include a flexible leaf spring extending along the lower transverse edges and each concave toward one of the boards.

4. The trouser press defined in claim 3 wherein each of the leaf springs has one end pivoted at the respective one edge which is one of the longitudinal edges and an opposite end.

5. The trouser press defined in claim 4 wherein the latch is spring loaded into a position retaining the leaf springs against the other board.

6. A trouser press comprising:

a pair of similar elongated boards each having a pair of generally parallel, vertical, and longitudinal edges and upper and lower transverse edges bridging same;

a heating plate similar to and between the boards and having respective such longitudinal and transverse edges, the plate being formed at the respective upper edge with a cutout, whereby a pair of trousers can be positioned with one trouser leg on one side of the plate, one trouser leg on the other, the trouser waistband generally at the upper edges, and the trouser crotch at the cutout;

means for heating the plate;

hinge means attaching the boards and plate together in registration with the heating plate sandwiched between the boards for pivoting of each of the boards relative to the plate along one of the plate edges and the corresponding board edge;

means including grippers at the upper edges for securing the trouser waistband of the trouser in the press; and further means including clips generally at the lower edges for securing the legs in the press, the clips each including a flexible leaf spring extending along the lower transverse edges and each concave toward one of the boards, each of the leaf springs having one end pivoted at the respective one edge which is one of the longitudinal edges and an opposite end, the further means including a latch on the other board releasably engageable with the opposite ends of the leaf springs.

7. The trouser press defined in claim 5 wherein the clip means is provided with at least one longitudinally extending pivot slidably carrying the one ends of the leaf springs, whereby the longitudinal positions of the leaf springs can be adjusted.

8. A trouser press comprising:

a pair of similar elongated boards each having a pair of generally parallel, vertical, and longitudinal edges and upper and lower transverse edges bridging same, each of the boards being formed of at least two parts;

transversely extending hinges connecting each of the parts of each of the boards to another part of the respective board;

a heating plate similar to and between the boards and having respective such longitudinal and transverse edges, the plate being formed at the respective upper edge with a cutout, whereby a pair of trousers can be positioned with one trouser leg on one side of the plate, one trouser leg on the other, the trouser waistband generally at the upper edges, and the trouser crotch at the cutout, the plate being formed of at least two parts;

transversely extending hinges connecting each of the parts of the plate to another part of the plate;

means for heating the plate; and hinge means attaching the boards and plate together in registration with the heating plate sandwiched between the boards for pivoting of each of the boards relative to the plate along one of the plate edges and the corresponding board edge.

9. The press defined in claim 8, further comprising means including grippers at said upper edges for securing the trouser waistband of the trouser in the press; and means including clips generally at said lower edges for securing the legs in the press.

10. The press defined in claim 8 wherein the cutout is formed on one of the parts of each of the boards and plate and the other parts thereof are interconnected by the hinge means.

11. The press defined in claim 8 wherein the boards and plate are covered with fabric that continues between the parts and forms the transversely extending hinges.

* * * * *